US007944427B2

(12) United States Patent
Choi

(10) Patent No.: US 7,944,427 B2
(45) Date of Patent: May 17, 2011

(54) LIQUID CRYSTAL DISPLAY AND DRIVING METHOD THEREOF

(75) Inventor: Byung Jin Choi, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 952 days.

(21) Appl. No.: 11/878,388

(22) Filed: Jul. 24, 2007

(65) Prior Publication Data

US 2008/0024692 A1 Jan. 31, 2008

(30) Foreign Application Priority Data

Jul. 26, 2006 (KR) ..... 10-2006-0070211

(51) Int. Cl.
*G09G 3/36* (2006.01)

(52) U.S. Cl. ..... 345/100; 345/98

(58) Field of Classification Search ..... 345/92, 345/94, 95, 98, 100, 204, 30, 55, 84, 87; 377/64–81

See application file for complete search history.

(56) References Cited

U.S. PATENT DOCUMENTS

| | | | | |
|---|---|---|---|---|
| 5,945,970 | A * | 8/1999 | Moon et al. | 345/92 |
| 6,359,607 | B1 * | 3/2002 | Yanagi et al. | 345/94 |
| 6,862,013 | B2 | 3/2005 | Takeuchi | |
| 6,903,734 | B2 * | 6/2005 | Eu | 345/211 |
| 7,002,542 | B2 * | 2/2006 | Lee | 345/94 |
| 7,327,338 | B2 * | 2/2008 | Moon | 345/87 |
| 7,333,586 | B2 * | 2/2008 | Jang | 377/64 |
| 7,460,114 | B2 * | 12/2008 | Mizumaki | 345/204 |
| 7,486,268 | B2 * | 2/2009 | Jang et al. | 345/100 |
| 7,710,372 | B2 * | 5/2010 | Hirakawa et al. | 345/87 |
| 2002/0011982 | A1 * | 1/2002 | Takeuchi et al. | 345/92 |
| 2004/0196275 | A1 * | 10/2004 | Hattori | 345/204 |
| 2005/0062706 | A1 * | 3/2005 | Mizumaki | 345/94 |
| 2005/0253832 | A1 * | 11/2005 | Chung | 345/204 |
| 2006/0022928 | A1 * | 2/2006 | Kim et al. | 345/94 |
| 2006/0125742 | A1 * | 6/2006 | Sekiguchi et al. | 345/80 |
| 2006/0145996 | A1 * | 7/2006 | Chang | 345/98 |
| 2006/0284820 | A1 * | 12/2006 | Hong et al. | 345/100 |

FOREIGN PATENT DOCUMENTS

| | | |
|---|---|---|
| CN | 1336568 A | 2/2002 |
| CN | 1680990 A | 10/2005 |

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display for supplying a discharge voltage for preventing a delay to reduce a delay of a scanning pulse, and a driving method thereof are disclosed. In the liquid crystal display, a liquid crystal display panel has a plurality of gate lines. A timing controller supplies a gate output enable signal which controls a supply of a scanning pulse. A discharging part generates a discharge voltage in response to the gate output enable signal. And a gate driver supplies the discharge voltage together with a scanning pulse to the gate lines in response to the gate output enable signal.

4 Claims, 5 Drawing Sheets

LIQUID CRYSTAL DISPLAY AND DRIVING METHOD THEREOF

This application claims the benefit of Korean Patent Application No. P2006-0070211 filed in Korea on Jul. 26, 2006, which is hereby incorporated by reference in its entirety.

BACKGROUND OF THE INVENTION

1. Field of the Invention

The present invention relates to a liquid crystal display, and more particularly to a liquid crystal display that is adaptive for supplying a discharge voltage for preventing a delay to reduce a delay of a scanning pulse, and a driving method thereof.

2. Description of the Related Art

Generally, a liquid crystal display controls light transmittance of liquid crystal cells in accordance with video signals to thereby display a picture. An active matrix type of liquid crystal display having a switching device provided for each liquid crystal cell is advantageous for an implementation of moving picture because it permits an active control of the switching device. The switching device used for the active matrix liquid crystal display mainly employs a thin film transistor (hereinafter, referred to as "TFT") as shown in FIG. 1.

Referring to FIG. 1, the liquid crystal display of the active matrix type converts a digital input data into an analog data voltage on the basis of a gamma reference voltage to supply it to a data line DL and, at the same time supply a scanning pulse to a gate line GL, thereby charging a liquid crystal cell Clc.

A gate electrode of the TFT is connected to the gate line GL, a source electrode is connected to the data line DL, and a drain electrode of the TFT is connected to a pixel electrode of the liquid crystal cell Clc and one end electrode of a storage capacitor Cst.

A common electrode of the liquid crystal cell Clc is supplied with a common voltage Vcom.

When the TFT is turned-on, the storage capacitor Cst charges a data voltage applied from the data line DL to constantly maintain a voltage of the liquid crystal cell Clc.

If the gate pulse is applied to the gate line GL, the TFT is turned-on to define a channel between the source electrode and the drain electrode, thereby supplying a voltage on the data line DL to the pixel electrode of the liquid crystal cell Clc. In this case, liquid crystal molecules of the liquid crystal cell Clc are arranged by an electric field between the pixel electrode and the common electrode to modulate an incident light.

A configuration of a liquid crystal display of a related art including pixels which have such a structure is the same as shown in FIG. 2.

FIG. 2 is a block diagram showing a configuration of a liquid crystal display of the related art.

Referring to FIG. 2, the liquid crystal display 100 of the related art includes a liquid crystal display panel 110, a data driver 120, a gate driver 130, a gamma reference voltage generator 140, a backlight assembly 150, an inverter 160, a common voltage generator 170, a gate driving voltage generator 180, and a timing controller 190. Herein, the data driver 120 supplies a data to the data lines DL1 to DLm of the liquid crystal display panel 110. The gate driver 130 supplies a scanning pulse to the gate lines GL1 to GLn of the liquid crystal display panel 110. The gamma reference voltage generator 140 generates a gamma reference voltage to supply it to the data driver 120. The backlight assembly 150 irradiates a light onto the liquid crystal display panel 110. The inverter 160 applies an AC voltage and a current to the backlight assembly 150. The common voltage generator 170 generates a common voltage Vcom to supply it to the common electrode of the liquid crystal cell Clc of the liquid crystal display panel 110. The gate driving voltage generator 180 generates a gate high voltage VGH and a gate low voltage VGL to supply them to the gate driver 130. The timing controller 190 controls the data driver 120 and the gate driver 130.

The liquid crystal display panel 110 has a liquid crystal dropped between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse which is applied via gate lines GL1 to GLn, to the gate terminal. Upon turning-on of the TFT, a video data on the data line DL1 to DLm is supplied to the pixel electrode of the liquid crystal cell Clc.

The data driver 120 supplies a data to the data lines DL1 to DLm in response to a data driving control signal DDC which is supplied from the timing controller 190. Further, the data driving circuit 120 converts digital video data RGB which are supplied from the timing controller 190 into an analog data voltage on the basis of a gamma reference voltage which is supplied from the gamma reference voltage generator 140 to supply it to the data lines DL1 to DLm. Herein, an analog data voltage is realized as a gray scale at the liquid crystal cell Clc of the liquid crystal display panel 110.

The gate driver 130 sequentially generates a scanning pulse in response to a gate driving control signal GDC and a gate shift clock GSC which are supplied from the timing controller 190 to supply them to the gate lines GL1 to GLn. In this case, the gate driver 130 determines a high level voltage and a low level voltage of the scanning pulse in accordance with the gate high voltage VGH and the gate low voltage VGL which are supplied from the gate driving voltage generator 180.

The gamma reference voltage generator 140 receives a high-level power voltage VDD to generate a positive gamma reference voltage and a negative gamma reference voltage to output them to the data driver 120.

The backlight assembly 150 is provided at the rear side of the liquid crystal display panel 110, and is radiated by an AC voltage and a current which are supplied from the inverter 160 to irradiate a light onto each pixel of the liquid crystal display panel 110.

The inverter 160 converts a square wave signal generated at the interior thereof into a triangular wave signal, and then compares the triangular wave signal with a direct current power voltage VCC supplied from the system to generate a burst dimming signal proportional to the result. If the burst dimming signal is generated, then a driving integrated circuit IC (not shown) within the inverter 160 controls a generation of AC voltage and current supplied to the backlight assembly 150 in accordance with the burst dimming signal.

The common voltage generator 170 receives a high-level power voltage VDD to generate a common voltage Vcom, and supplies it to the common electrode of the liquid crystal cells Clc provided at each pixel of the liquid crystal display panel 110.

The gate driving voltage generator 180 is supplied with a power voltage of 3.3V which is supplied from the system to generate the gate high voltage VGH and the gate low voltage VGL, and supplies them to the gate driver 130. Herein, the gate driving voltage generator 180 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 190 supplies digital video data RGB which are supplied from a system such as a TV set or a computer monitor, etc to the data driver 120. Furthermore, the timing controller 190 generates a data driving control signal DCC and a gate driving control signal GDC using horizontal/vertical synchronization signals H and V from a system in response to a clock signal CLK from a system to supply them to the data driver 120 and the gate driver 130, respectively. Herein, the data driving control signal DDC includes a source shift clock SSC, a source start pulse SSP, a polarity control signal POL, and a source output enable signal SOE, etc.

Furthermore, the timing controller 190 supplies a gate driving control signal GDC, a gate shift clock GSC, and a gate output enable signal GOE, etc to the gate driver 130. Such a gate output enable signal GOE is supplied to the gate driver 130 to maintain a width of a scanning pulse.

In other words, the gate driver 130 adjusts a width of a scanning pulse, which is supplied to the gate line GL in accordance with a gate output enable signal GOE of which a high interval thereof and a low interval thereof are repeated with a constant period as shown in FIG. 3, to supply the scanning pulse to the gate line GL.

Referring to FIG. 3, the gate driver 130 supplies a scanning pulse to the gate line GL for a period which is ranged from a falling point of a pre-order high interval to a rising point of a post-order high interval among high intervals of the adjacent gate output enable signal GOE, that is, a scanning pulse supply period ST. Herein, the gate driver 130 outputs an ideal scanning pulse ISP. However, a delayed scanning pulse RSP is supplied to the gate line GL because a formation of a scanning pulse is distorted and a scanning pulse is delayed by a parasitic capacitor and a resistance component of the gate line GL. Since a scanning pulse is delayed, a delayed scanning pulse RSP is also supplied for a delay period DT including the post-order high interval HT of a gate output enable signal GOE and a partial low interval OT among low intervals following the post-order high interval HT after the scanning pulse supply period ST goes by.

In this way, when a Nth scanning pulse with which a Nth gate line is supplied is delayed for a delay period DT, a (N+1)th scanning pulse is supplied to a (N+1)th gate line from a falling point of the post-order high interval HT of a gate output enable signal GOE. Thus, a Nth scanning pulse is overlapped with a (N+1)th scanning pulse for the partial low interval OT among low intervals following the post-order high interval HT of a gate output enable signal GOE.

As described above, in the liquid crystal display of the related art, a scanning pulse is delayed by a parasitic capacitor and a resistance component of the gate line, so that a charging time of a pixel is decreased and brightness is reduced. Furthermore, a part of scanning pulses with which the adjacent gate lines is supplied, is overlapped. As a result, a gray scale is abnormally realized.

SUMMARY OF THE INVENTION

The present invention is to solve the above-mentioned problem. Accordingly, it is an object of the present invention to provide a liquid crystal display that is adaptive for supplying a discharge voltage for preventing a delay to reduce a delay of a scanning pulse, and a driving method thereof.

It is another object of the present invention to provide a liquid crystal display that is adaptive for supplying a discharge voltage for preventing a delay to reduce a delay of a scanning pulse, thereby increasing a charging time of a pixel.

It is another object of the present invention to provide a liquid crystal display that is adaptive for supplying a discharge voltage for preventing a delay to reduce a delay of a scanning pulse, thereby preventing scanning pulses with which the adjacent scanning lines is supplied from being overlapped with each other.

In order to achieve these and other objects of the invention, a liquid crystal display device according to the present invention comprises a liquid crystal display panel having a plurality of gate lines; a timing controller that supplies a gate output enable signal which controls a supply of a scanning pulse; a discharging part that generates a discharge voltage in response to the gate output enable signal; and a gate driver that sequentially supplies the scanning pulse to the gate lines and supplies the discharge voltage together with the scanning pulse to the gate lines in response to the gate output enable signal.

The discharging part is synchronized at a rising point of a high interval of the gate output enable signal to supply the discharge voltage to the gate driver.

The gate driver is synchronized at a rising point of a high interval of the gate output enable signal to supply the discharge voltage to the gate lines.

A method of driving a liquid crystal display, including a liquid crystal display panel having a plurality of gate lines, the method comprises generating a gate output enable signal that controls a supply of a scanning pulse; generating a discharge voltage in response to the gate output enable signal; and sequentially supplying the scanning pulse to the gate lines and supplying the discharge voltage together with the scanning pulse to the gate lines in response to the gate output enable signal.

In the method, the step of generating the discharge voltage is synchronized at a rising point of a high interval of the gate output enable signal to generate the discharge voltage.

In the method, the step of supplying the scanning pulse is synchronized at a rising point of a high interval of the gate output enable signal to supply the discharge voltage to the gate lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to the accompanying drawings.

Figure 4:
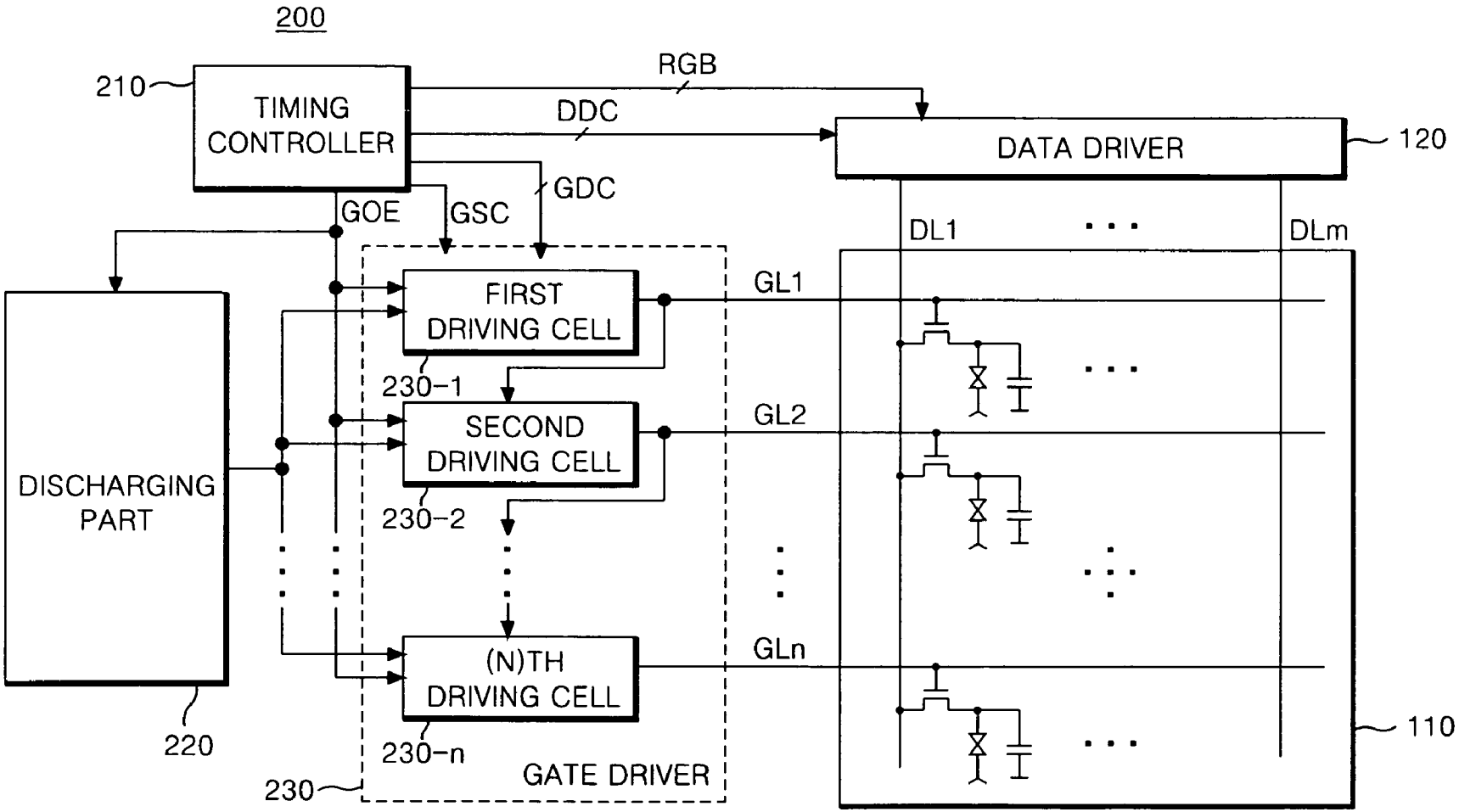
FIG. 4 is a diagram showing a configuration of a liquid crystal display according to an embodiment of the present invention.

FIG. 4 is a diagram showing a configuration of a liquid crystal display according to an embodiment of the present invention.

Referring to FIG. 4, the liquid crystal display 200 of the present invention includes a timing controller 210, a discharging part 220, and a gate driver 230. Herein, the timing controller 210 supplies a gate output enable signal GOE that controls a supply of a scanning pulse. The discharging part 220 generates a discharge voltage for preventing a delay in response to a gate output enable signal GOE from the timing controller 210. The gate driver 230 sequentially supplies a scanning pulse to the gate lines GL1 to GLn on the liquid crystal display panel 110 and supplies a discharge voltage, which is inputted from the discharging part 220, together with a scanning pulse to the gate lines GL1 to GLn in response to a gate output enable signal GOE from the timing controller 210.

The timing controller 210 supplies digital video data RGB which are supplied from a system such as a TV set or a computer monitor, etc to the data driver 120. Furthermore, the timing controller 210 generates a data driving control signal DCC and a gate driving control signal GDC using horizontal/vertical synchronization signals H and V from a system in response to a clock signal CLK from a system to supply them to the data driver 120 and the gate driver 130, respectively. Herein, the data driving control signal DDC includes a source shift clock SSC, a source start pulse SSP, a polarity control signal POL, and a source output enable signal SOE, etc.

Furthermore, the timing controller 210 supplies a gate driving control signal GDC and a gate shift clock GSC, etc to the gate driver 230 and supplies a gate output enable signal GOE to the discharging part 220 and the gate driver 230.

The discharging part 220 supplies a discharge voltage, which is used for preventing a delay of a scanning pulse, to the gate driver 230 in response to a gate output enable signal GOE from the timing controller 210. In this case, the discharging part 220 is synchronized at a rising point of a high interval of a gate output enable signal GOE to supply a discharge voltage.

Figure 5:
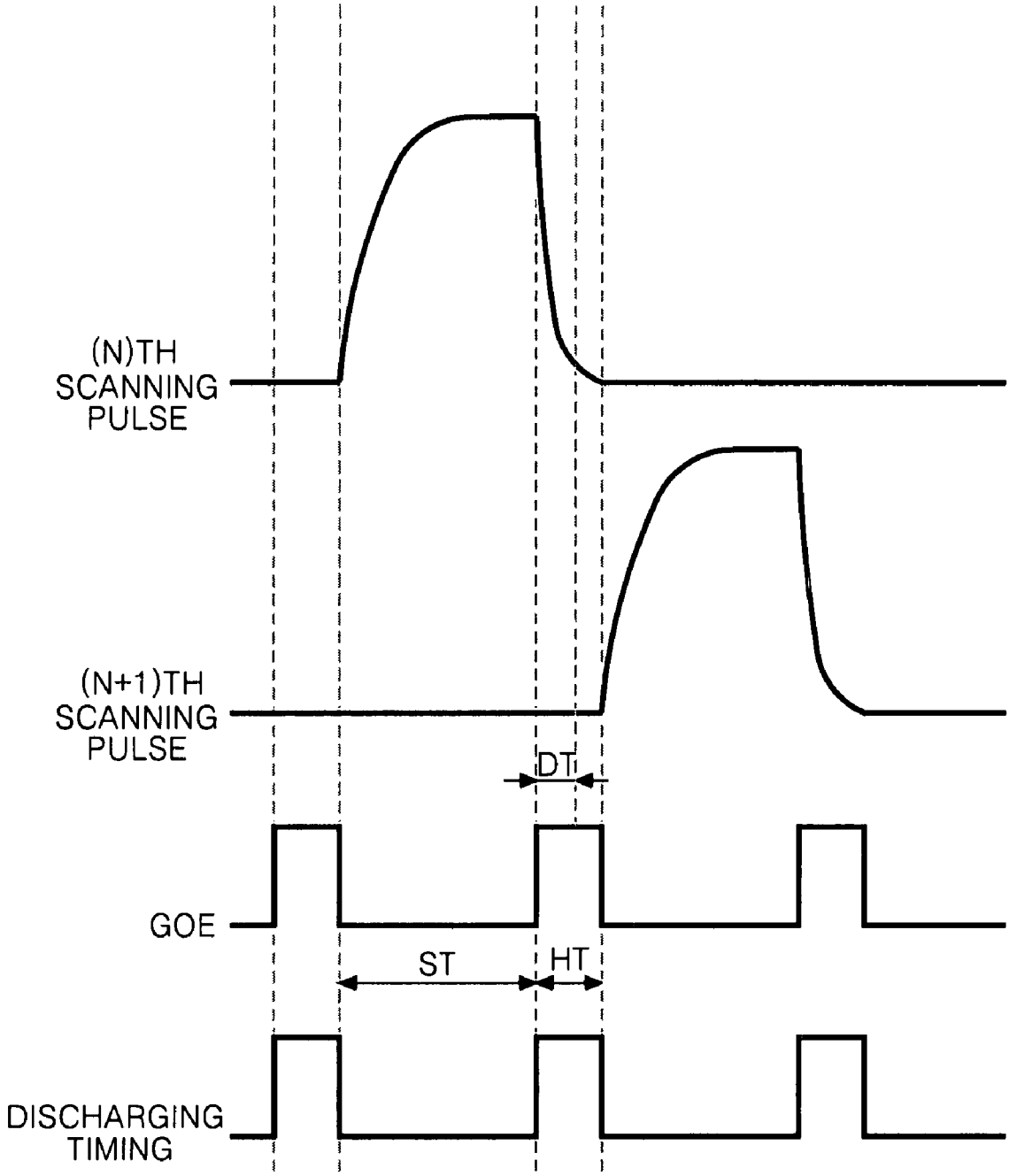
FIG. 5 is a diagram showing a characteristics of a signal for explaining a driving characteristics of gate lines which are provided at the liquid crystal display according to the present invention.

The gate driver 230 sequentially supplies a scanning pulse to the gate lines GL1 to GLn in response to a gate driving control signal GDC and a gate shift clock GSC, which are supplied from the timing controller 210. Herein, the gate driver 230 supplies a scanning pulse to the gate line GL for a period which is ranged from a falling point of the pre-order high interval to a rising point of the post-order high interval among high intervals of the adjacent gate output enable signal GOE, that is, a scanning pulse supply period ST as shown in FIG. 5, and is synchronized at a rising point of the post-order high interval among high intervals of the adjacent gate output enable signal GOE to supply a discharge voltage from the discharging part 220 to the gate line GL.

Such a gate driver 230 includes a first to nth driving cells 230-1 to 230-n, which are connected to correspond to the gate lines GL1 to GLn.

The first driving cell 230-1 is driven by a gate start pulse GSP, which is supplied from the timing controller 210, to supply a scanning pulse to the gate line GL1.

The second driving cell 230-2 is driven by a scanning pulse, which is supplied from the first driving cell 230-1, to supply a scanning pulse to the gate line GL2.

The nth driving cell 230-n is driven by a scanning pulse, which is supplied from the (n−1)th driving cell 230-(n−1), to supply a scanning pulse to the gate line GLn.

A third to (n−1)th driving cells are driven by the above-mentioned process to supply a scanning pulse to the gate line, which is connected to thereof.

The first to nth driving cells 230-1 to 230-n supply a scanning pulse to the gate line GL for a period which is ranged from a falling point of the pre-order high interval to a rising point of the post-order high interval of a gate output enable signal GOE, which is supplied from the timing controller 210, that is, a scanning pulse supply period ST as shown in FIG. 5, and is synchronized at a rising point of the post-order high interval of a gate output enable signal GOE, which is supplied from the timing controller 210 to supply a discharge voltage from the discharging part 220 to the gate line.

In this way, if a discharge voltage is supplied, an Nth scanning pulse, which is supplied for the scanning pulse supply period ST, is delayed for a partial period DT of the beginning at the post-order high interval HT of a gate output enable signal GOE, which is supplied after the scanning pulse supply period ST goes by as shown in FIG. 5. Thus, a Nth scanning pulse is not overlapped with a (N+1)th scanning pulse, which is supplied from a falling point of the post-order high interval HT of a gate output enable signal GOE.

Figure 1:
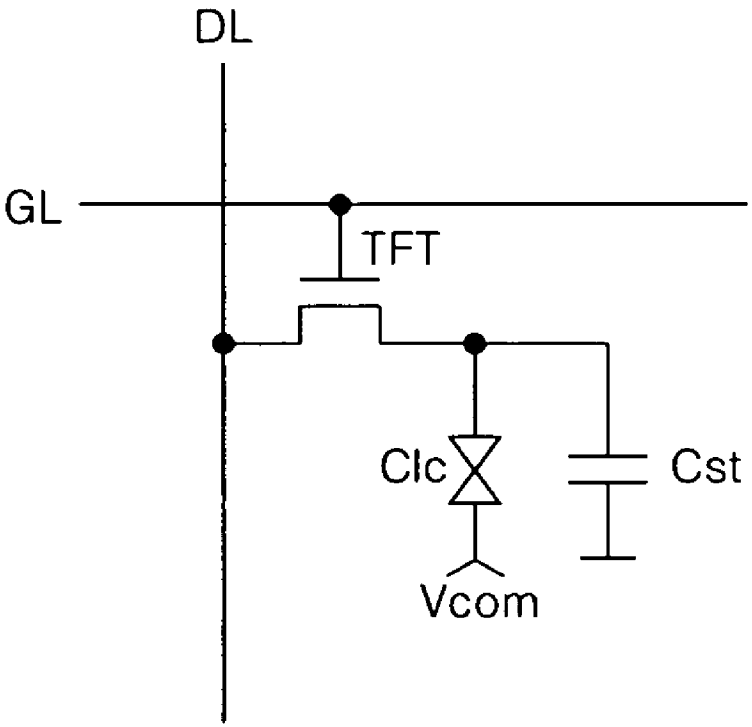
FIG. 1 RELATED ART
FIG. 1 is an equivalent circuit diagram showing a pixel provided at a liquid crystal display of the related art.
Figure 2:
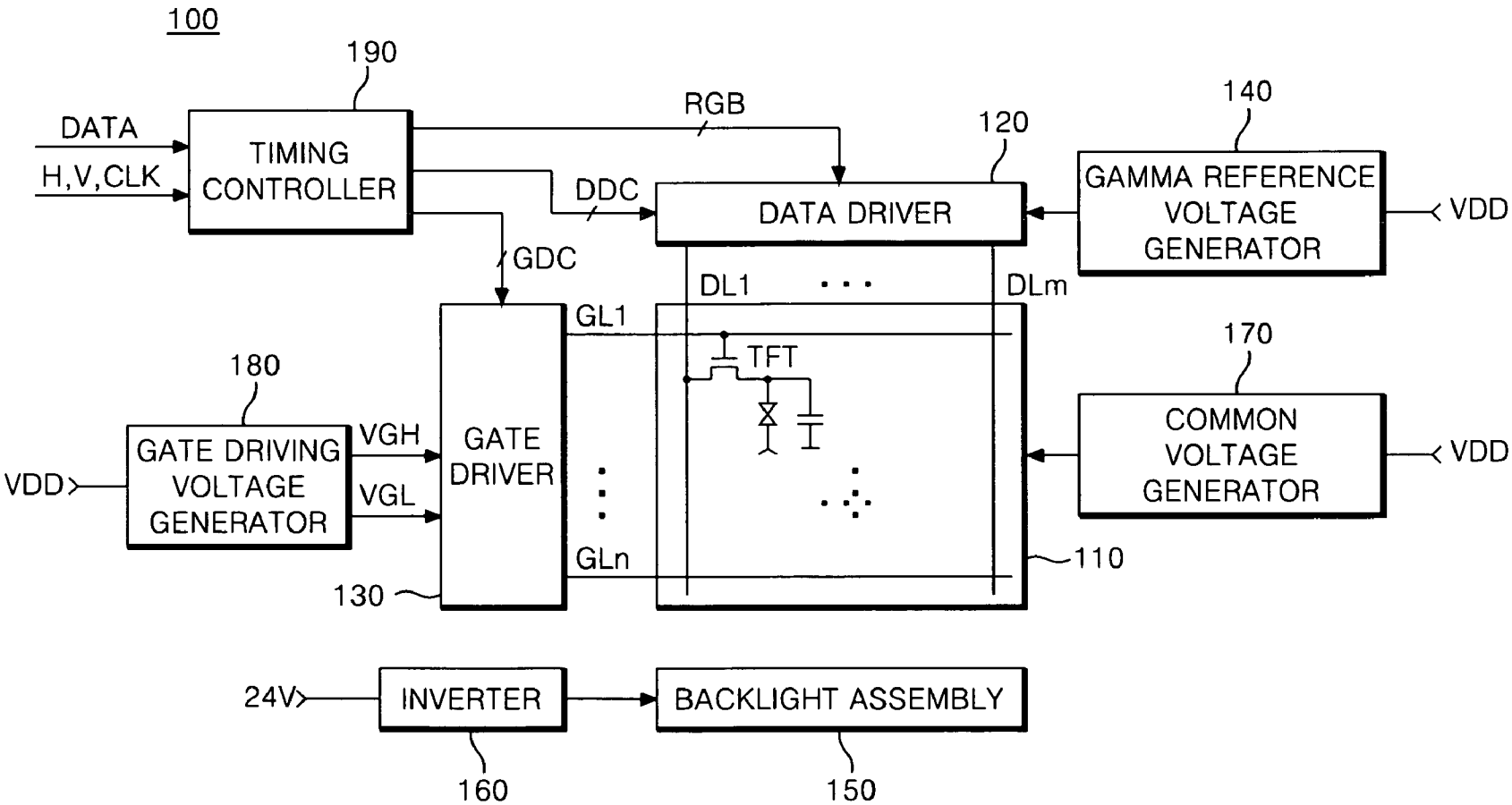
FIG.2 RELATED ART
FIG. 2 is a block diagram showing a configuration of the liquid crystal display of the related art.
Figure 3:
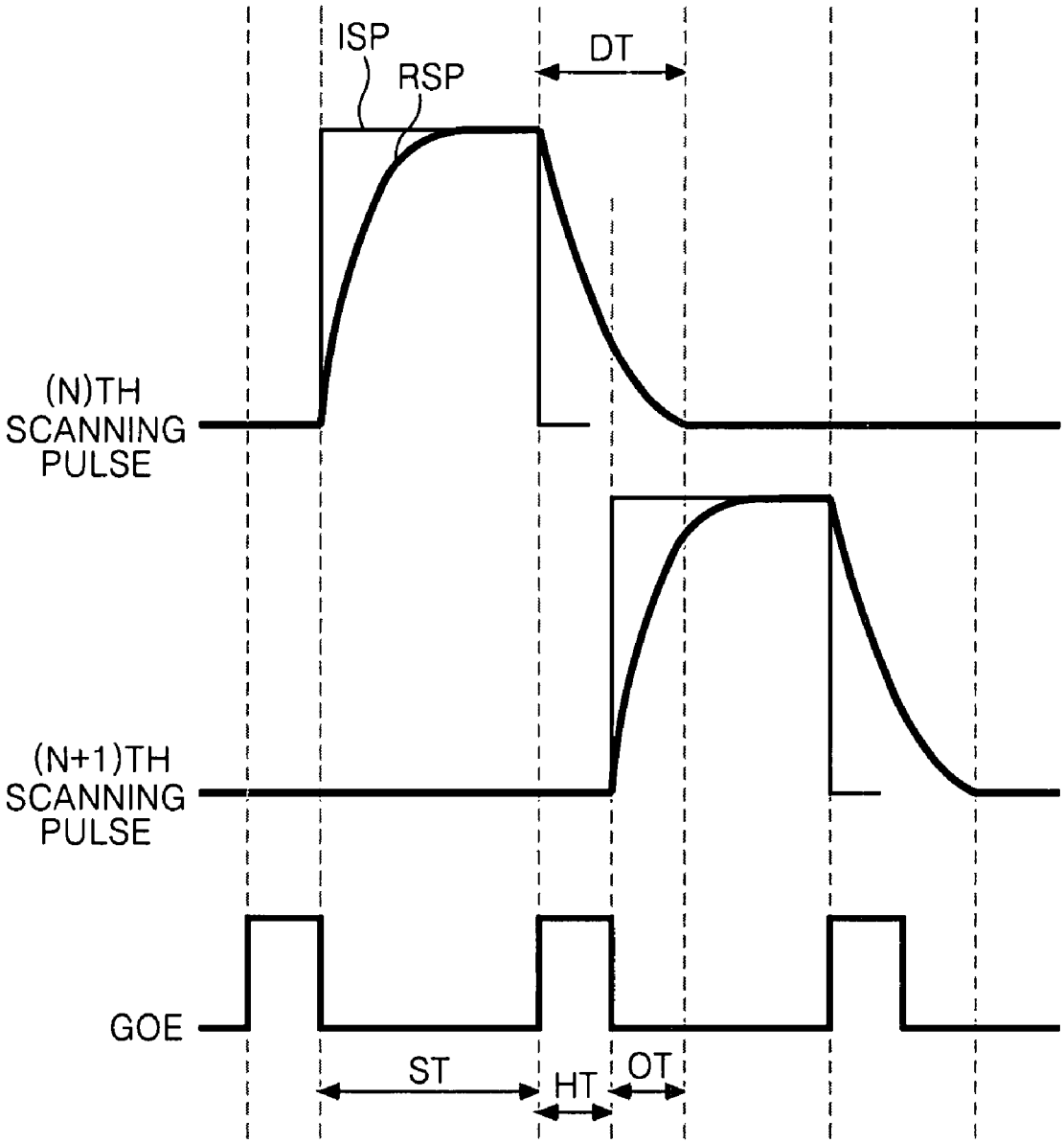
FIG.3 RELATED ART
FIG. 3 is a diagram showing a characteristics of a signal for explaining a driving characteristics of gate lines which are provided at the liquid crystal display of the related art.

A delayed time of a scanning pulse, which is generated when the first to nth driving cells 230-1 to 230-n supply a discharge voltage to the gate line will be compared with a delayed time of a scanning pulse, which is generated when the first to nth driving cells 230-1 to 230-n do not supply a discharge voltage to the gate line with reference to FIG. 3 and FIG. 5. According to the compared result, the liquid crystal display 200 of the present invention reduces about three-times a delayed time of a scanning pulse compared to the liquid crystal display 100 of the related art. Thus, the present invention prevents scanning pulses, which are supplied to be adjacent to each other, from being overlapped with each other.

As described above, the present invention supplies a discharge voltage for preventing a delay to reduce a delay of a scanning pulse. Thus, the present invention increases a charging time of a pixel to prevent a deterioration of brightness. Furthermore, the present invention prevents scanning pulses, which are supplied to the adjacent scan lines, from being overlapped with each other to normally realize a gray scale.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a liquid crystal display panel having a plurality of gate lines;

a timing controller that supplies a gate output enable signal which controls a supply of a scanning pulse;

a discharging part that generates a discharge voltage for preventing a delay of the scanning pulse in response to the gate output enable signal; and a gate driver that sequentially supplies the scanning pulse to the gate lines and supplies the discharge voltage together with the scanning pulse to the gate lines, in response to the gate output enable signal, wherein the discharging part is synchronized at a rising point of a high interval of the gate output enable signal to supply the discharge voltage to the gate driver, wherein the scanning pulse is supplied to the gate lines for a period which is ranged from a falling point of a pre-order high interval to a rising point of a post-order high interval of the gate output enable signal, wherein when the discharge voltage is supplied to the gate lines, the scanning pulse is delayed for a partial period of the beginning at the post-order high interval of the gate output enable signal.

2. The liquid crystal display according to claim 1, wherein the gate driver is synchronized at a rising point of a high interval the gate output enable signal to supply the discharge voltage to the gate lines.

3. A method of driving a liquid crystal display, including a liquid crystal display panel having a plurality of gate lines, the method comprising:

generating a gate output enable signal that controls a supply of a scanning pulse;

generating a discharging voltage in response to the gate output enable single; and sequentially supplying the scanning pulse to the gate lines and supplying the discharge voltage together with the scanning pulse to the gate lines, in response to the gate output enable signal, wherein the step of generating the discharge voltage is synchronized at a rising point of a high interval of the gate output enable signal to generate the discharge voltage, wherein the scanning pulse is supplied to the gate lines for a period which is ranged from a falling point of a pre-order high interval to a rising point of a post-order high interval of the gate output enable signal, wherein when the discharge voltage is supplied to the gate lines, the scanning pulse is delayed for a partial period of the beginning at the post-order high interval of the gate output enable signal.

4. The method of driving the liquid crystal display according to claim 3, wherein the step of supplying the scanning pulse is synchronized at a rising point of a high interval of the gate output enable signal to supply the discharge voltage to the gate lines.

* * * * *